US005238066A

United States Patent [19]

Beattie et al.

[11] Patent Number: 5,238,066

[45] Date of Patent: Aug. 24, 1993

[54] METHOD AND APPARATUS FOR IMPROVED RECOVERY OF OIL AND BITUMEN USING DUAL COMPLETION CYCLIC STEAM STIMULATION

[75] Inventors: Craig I. Beattie; Joseph R. Korol, both of Calgary, Canada

[73] Assignee: Exxon Production Research Company, Houston, Tex.

[21] Appl. No.: 856,788

[22] Filed: Mar. 24, 1992

[51] Int. Cl.[5] ..... E21B 36/00; E21B 43/24

[52] U.S. Cl. ..... 166/303; 166/57; 166/306; 166/313

[58] Field of Search ..... 166/57, 303, 306, 313

[56] References Cited

U.S. PATENT DOCUMENTS

| | | | |
|---|---|---|---|
| Re. 25,918 | 11/1965 | Craig, Jr. et al. | 166/306 X |
| 2,593,497 | 4/1952 | Spearow | 166/306 X |
| 3,765,483 | 10/1973 | Vencil | 166/313 X |
| 3,796,265 | 3/1974 | Eickmeier | 166/303 |
| 3,993,135 | 11/1976 | Sperry et al. | 166/57 X |
| 3,994,341 | 11/1976 | Anderson et al. | 166/272 |
| 4,399,865 | 8/1983 | Anderson et al. | 166/57 X |
| 4,403,656 | 9/1983 | Ploeg et al. | 166/57 X |
| 4,595,057 | 6/1986 | Deming et al. | 166/57 X |
| 4,844,156 | 7/1989 | Hesh | 166/303 X |
| 5,014,784 | 5/1991 | Shen | 166/263 |
| 5,131,471 | 7/1992 | Duerksen et al. | 166/306 X |

*Primary Examiner*—George A. Suchfield
*Attorney, Agent, or Firm*—John R. Casperson

[57] ABSTRACT

A method and apparatus whereby recovery from heavy oil and bitumen reservoirs may be increased over that achieved in the later stages of cyclic steam stimulation (CSS) operations. Two sets of perforations perforate a steam chamber in a reservoir surrounding a well. The two sets of perforations are isolated hydraulically from each other within the casing by a thermal packer. Steam is then injected down the casing annulus into the upper set of perforations. After a period of steam injection, steam injection is halted and hydrocarbons are produced from the lower set of perforations through one of two strings of tubing extending through the thermal packer. The second string of tubing serves to vent the well during production. This process may be repeated over the life of the well, alternately injecting steam and producing hydrocarbons.

12 Claims, 1 Drawing Sheet

METHOD AND APPARATUS FOR IMPROVED RECOVERY OF OIL AND BITUMEN USING DUAL COMPLETION CYCLIC STEAM STIMULATION

BACKGROUND OF THE INVENTION

1. Field of the Invention

This invention relates to a method and apparatus for increasing hydrocarbon production from heavy oil and bitumen reservoirs.

2. Description of the Related Art

Hydrocarbon production from heavy oil and bitumen reservoirs is commonly achieved through the use of a cyclic steam stimulation (CSS) process. In this process, individual wells are alternately used as steam injection wells and then as production wells. The steam is commonly injected into the same zone as the hydrocarbons are to be produced from, using a same set of perforations in the well casing.

A major drawback exists in any process using the same set of perfs for injection and production. Each time steam is injected into the perforations, oil just outside the perforations is pushed further away from the well by the steam, so that at the end of the injection, the reservoir adjacent to the perforations contains only irreducible oil and large quantities of steam and heat. When the well is put on production, it initially produces only water, steam, and heat, rather than the desired hydrocarbons. Well production is delayed until the oil can move back to the wellbore from farther out in the formation. As cumulative recovery from the well increases, the oil remaining to be recovered is farther and farther from the wellbore. The high heat production and delayed oil production make the currently used CSS process less and less efficient with time.

U.S. Pat. No. 3,994,341 to Anderson, et al. proposes a system for use in heavy oil reservoirs whereby two sets of perforations are separated by a thermal packer. An additional closed-loop flow path is extended past both sets of perforations and a hot fluid is run through the flow loop to facilitate injectivity of the upper perforations. The upper perforations are then injected with a hot drive fluid at the same time as hydrocarbons are produced through a tubing string from the lower set of perforations.

Two drawbacks are inherent in this method. First, it requires the use of a special closed loop flow path. There are several disadvantages to this. Running the flow path into the well takes a substantial amount of time, and, hence, is costly. Operation of the flow path is even more time consuming. Heat conduction is a slow process, adding a significant additional time delay before a well can be brought on production. This, again, is lost income. Finally, placing excess equipment downhole uses valuable space and increases the chance of mechanical problems with the well. The second drawback to this method is the poor efficiency achieved through simultaneous injection and production. Simultaneous injection and production decreases drive energy and increases coning. Thus production, when it occurs, is less efficient.

SUMMARY OF THE INVENTION

This invention provides a method and apparatus whereby recovery from heavy oil and bitumen reservoirs may be increased over that achieved in the later stages of CSS operations.

In a preferred embodiment of the invention, a casing set in a well has two sets of perforations, both sets of perforations located so as to perforate a steam chamber existing in a reservoir surrounding the well. A thermal packer set within the casing hydraulically isolates the two sets of perforations within the casing. A conduit means for producing hydrocarbons from the well extends from the surface of the earth to a zone in the well adjacent to the first, lower set of perforations. A conduit means for venting the well extends from the surface of the earth to a zone in the well between the thermal packer and the first set of perforations. A steam source is provided, and a conduit for providing a flow path extends from the steam source to the inside of the casing.

In another preferred embodiment of the invention, a method for increasing hydrocarbon production from a heavy hydrocarbon reservoir comprises setting a thermal packer in a casing within a well, between a first set of perforations and a second, higher set of perforations, so as to hydraulically isolate the first set of perforations from the second set of perforations within the casing. The method further comprises injecting steam into the second set of perforations, then discontinuing the injection of steam and producing hydrocarbons from the first set of perforations. An area in the well adjacent to the first set of perforations is vented during the time that hydrocarbons are being produced.

This invention eliminates the poor recovery of the later stages of CSS production. This invention does not require substantial excess equipment in the wellbore, it does not have a long initial delay during which no hydrocarbon is produced, and it results in more efficient production than does simultaneous injection and production.

These figures are not intended to define the present invention, but are provided solely for the purpose of illustrating a preferred embodiment and application of the present invention.

DETAILED DESCRIPTION OF THE PREFERRED EMBODIMENT

In accordance with one embodiment of the present invention, there is provided an apparatus for increasing production from heavy oil and bitumen reservoirs after an initial period of CSS production. A casing indicated at 117 in FIG. 1 and at 217 in FIG. 2, set in a well, has a first end, indicated at 100 in FIG. 1, located within the well at a distance beneath the surface of the earth and a second end, indicated at 102 in FIG. 1, at the surface of the earth. The casing has two sets of perforations, a first set, indicated at 107 in FIG. 1 and at 207 in FIG. 2, and a second set, indicated at 111 in FIG. 1 and at 211 in FIG. 2. The second set of perforations is located in the casing between the first set of perforations and the surface of the earth. Both sets of perforations are located so as to perforate a steam chamber in a reservoir adjacent to the well. A thermal packer, indicated at 109 in FIG. 1 and at 209 in FIG. 2, is affixed within the casing between the first set of perforations, indicated at 107 in FIG. 1 and at 207 in FIG. 2, and the second set of perforations, indicated at 111 in FIG. 1 and 211 in FIG. 2.

This thermal packer serves to hydraulically isolate the first set of perforations from the second set of perforations within the casing. A means for producing hydrocarbons, indicated at 101 in FIG. 1 and 201 in FIG. 2, is extended between the surface of the earth and a zone in the well, indicated at 105 in FIG. 1 and at 205 in FIG. 2, adjacent to the first set of perforations, indicated at 107 in FIG. 1 and at 207 in FIG. 2. A means for Venting the well, indicated at 103 in FIG. 1 and at 203 in FIG. 2, is extended between the surface of the earth and a zone in the well, between the thermal packer indicated at 109 in FIG. 1 and 209 in FIG. 2, and the upper most perforation of the first set of perforations, indicated at 107 in FIG. 1 and at 207 in FIG. 2. In one simulation, the lower end of the means for venting the well was located 1-2 feet above the uppermost production perforation. A steam source, indicated at 113 in FIG. 1, is connected to the well by means indicated at 115 in FIG. 1, for providing a flow path from the steam source to a zone adjacent to the second set of perforations, indicated at 111 in FIG. 1.

Figure 1:
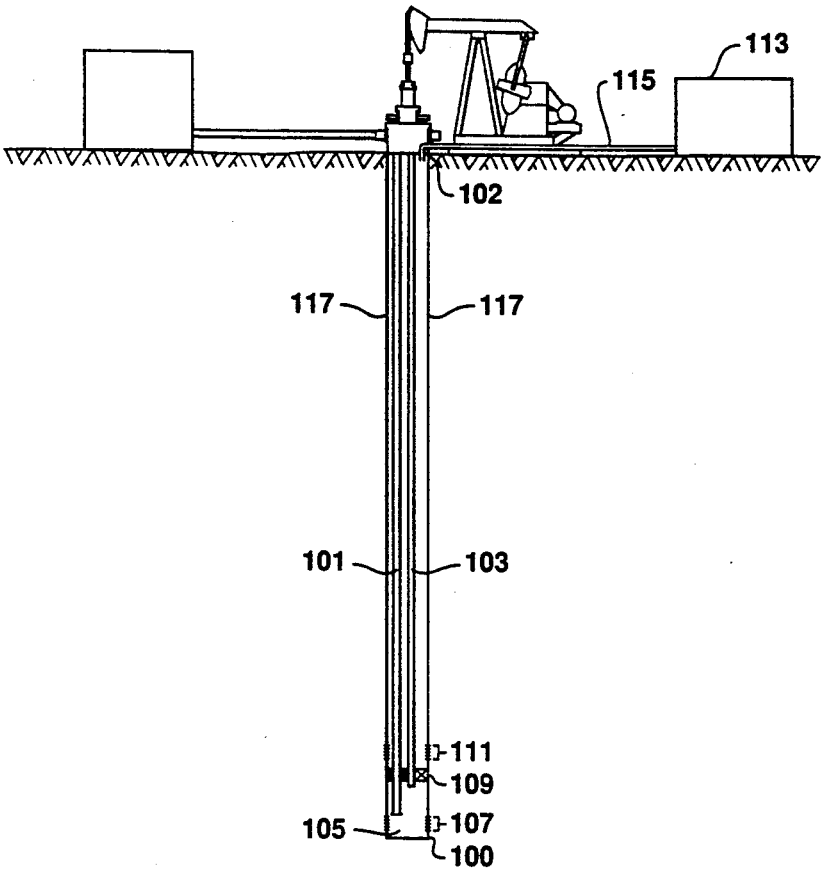
FIG. 1 illustrates pictorially the basic components of the invention.
Figure 2:
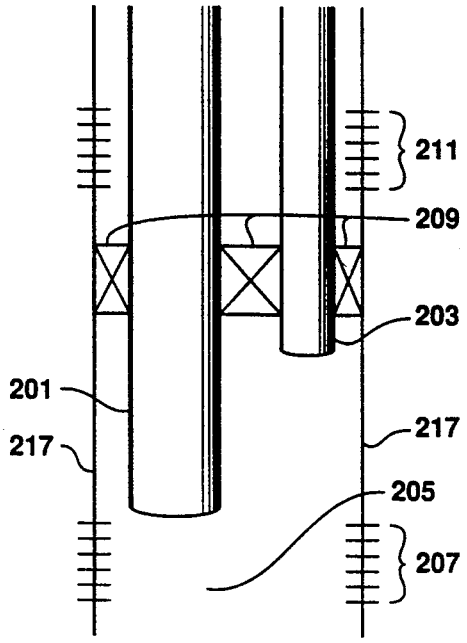
FIG. 2 illustrates a portion of the invention placed in proximity to a production zone.

In one embodiment of the invention, the means for producing hydrocarbons, indicated at 101 in FIG. 1 and at 201 in FIG. 2, is a first string of tubing. The diameter of the first string of tubing is ideally identical to that which would be used in conventional production operations.

In a further embodiment of the invention, the means for venting the well, indicated at 103 in FIG. 1 and at 203 in FIG. 2, is a second string of tubing. The diameter of the means for venting the well is determined by expected vent volumes and mechanical clearance requirements in the wellbore. The use of a means for venting the well is important, as the well may vapor lock and cease production if not properly vented. Preferably, the means for venting the well, indicated at 103 in FIG. 1 and at 203 in FIG. 2, is connected to a production flow line at the well head.

In a further embodiment of the invention, the first end of the means for venting the well, indicated at 203 in FIG. 2, is located closer to the surface of the earth than the first end of the means for producing hydrocarbons, indicated at 201 in FIG. 2.

In another embodiment of the invention, means for providing a flow path, indicated at 115 in FIG. 1, from the steam source, indicated at 113 in FIG. 1, to a zone adjacent to the second set of perforations, indicated at 111 in FIG. 1, comprises a tubular conduit in flow communication with the steam source and the casing. The thermal packer, indicated at 109 in FIG. 1, insures that steam injected down the annulus enters the formation through the upper set of perforations.

In accordance with another embodiment of the invention there is provided a method for increasing hydrocarbon production from heavy oil and bitumen reservoirs. This method is employed after a steam chamber has been established within a reservoir adjacent to a well. Initial production employing cyclic steam stimulation (CSS) will establish such a steam chamber. The method comprises setting a thermal packer, indicated at 109 in FIG. 1 and at 209 in FIG. 2, in a casing within the well between a first set of perforations, indicated at 107 in FIG. 1 and at 207 in FIG. 2, and a second set of perforations, indicated at 111 in FIG. 1 and 211 in FIG. 2. Both sets of perforations are located so as to perforate the steam chamber in the reservoir adjacent to the well. The second set of perforations, indicated at 111 in FIG. 1 and 211 in FIG. 2, is located between the first set of perforations, indicated at 107 in FIG. 1 and at 207 in FIG. 2, and the surface of the earth. Generally, the first set of perforations will have been used for previous steam injection and production, and the second set of perforations is added. The thermal packer, indicated at 109 in FIG. 1 and 209 in FIG. 2, is affixed within the casing so as to hydraulically isolate the first set of perforations from the second set of perforations within the casing. Steam is then injected into the second set of perforations, indicated at 111 in FIG. 1 and at 211 in FIG. 2. The injection of steam is discontinued after a period of time and hydrocarbons are produced from the first set of perforations, indicated at 107 in FIG. 1 and at 207 in FIG. 2. During the time hydrocarbons are being produced, the area in the well adjacent to the first set of perforations is vented. One simulation run on a numerical thermal reservoir simulator envisioned a period of 6-8 weeks during which steam was injected, followed by approximately 1 year during which the first set of perforations was produced. Injection and production periods will vary over the life of a well.

In one embodiment of the invention, a method further comprises flowing steam through a tubular conduit to the area of the well adjacent to the second set of perforations. Preferably, the tubular conduit comprises a string of pipe, indicated at 115 in FIG. 1, at or near the surface of the earth, and a casing set in the well, indicated at 217 in FIG. 2.

In a further embodiment of the invention, the first set of perforations is produced by means of a first string of tubing having a first end located adjacent to the first set of perforations in the well, and a second end located at or near the surface of the earth . The first end of the first string of tubing, indicated at 201 in FIG. 2, is preferably beneath the first end of the means for venting the well, indicated at 203 in FIG. 2.

In another embodiment of the invention, a zone adjacent to the first set of perforations, indicated at 107 in FIG. 1 and at 207 in FIG. 2, is vented by means of a second string of tubing, indicated at 103 in FIG. 1 and at 203 in FIG. 2, having a first end located between the thermal packer and the first set of perforations, indicated at 107 in FIG. 1 and at 207 in FIG. 2, and a second end located at the surface of the earth. It is important for the proper venting of the well that this string be above the uppermost of the first set of perforations. FIG. 2 illustrates one preferred simulation in which the vent string just pierces the thermal packer and the first set of perforations is located at a depth approximately two feet below the packer.

In a preferred embodiment of the invention, the second end of the second string of tubing is connected to a production flow line at the well head.

A CALCULATED EXAMPLE

A calculated example uses a numerical thermal reservoir simulator. Production modeled is based on an initial stage of CSS production, followed by implementation of the invention. The invention is implemented after five cycles of standard CSS operation. Depth to the top of the producing formation is 1500 ft (457.5 m.); reservoir thickness is 148 ft. (45.1 m.). The well would have only the lower set of perforations during the initial cycle. These perforations are located from −1579 ft. to −1599 ft. (−481.6 m. to −487.7 m.). An upper set of perforations is then added between −1530 ft. (−466.7 m.) and −1540 ft. (−469.7 m.), with 39 ft. (11.9 m.) of unperforated section between the two sets of perforations. Casing diameter of the well is 7 in. (11.9 cm). Production tubing diameter is $2\frac{7}{8}$ in. (7.3 cm) and vent tubing diameter is $1\frac{1}{2}$ in. (3.8 cm). Steam injection volumes and cycle lengths are listed in Table I.

Over 16 cycles, implementation of the invention would produce 42,016 more barrels of oil (or 7.4% more oil) than production using only standard CSS. The recovery increase results from an increase in total fluid production, accompanied by a decrease in water-oil ratio. The heat content of produced fluids using the invention would be 10% lower than with CSS, and the extra heat left in the reservoir increases gas and steam saturations in the formation, thereby increasing pressure maintenance effects and allowing more fluid to be produced.

TABLE I

| | Injection/Production Schedule | | |
|---|---|---|---|
| Cycle | Steam Injected | Steaming Days | Producing Days |
| 1 | 50318 | 32 | 130 |
| 2 | 44029 | 28 | 168 |
| 3 | 50318 | 32 | 213 |
| 4 | 59753 | 38 | 279 |
| 5 | 69188 | 44 | 323 |
| 6 | 81768 | 52 | 381 |
| 7 | 94347 | 60 | 440 |
| 8 | 106927 | 68 | 499 |
| 9 | 122651 | 75 | 572 |
| 10 | 138376 | 75 | 645 |
| 11 | 154100 | 82 | 719 |
| 12 | 169825 | 90 | 792 |
| 13 | 185549 | 98 | 865 |
| 14 | 204419 | 108 | 953 |
| 15 | 223288 | 118 | 1041 |
| 16 | 242158 | 128 | 1129 |

We claim:

1. An apparatus for increasing hydrocarbon production from a heavy hydrocarbon reservoir comprising:

a. a casing set in a well, said casing having a first end at a distance beneath the surface of the earth and a second end at the surface of the earth, and said casing having a first set of perforations and a second set of perforations, said second set of perforations located between the first set of perforations and the second end of the casing, and both the first set of perforations and the second set of perforations located so as to perforate a steam chamber located in a reservoir surrounding the well;

b. a thermal packer affixed within the casing such that the thermal packer serves to hydraulically isolate the first set of perforations from the second set of perforations within the casing;

c. a conduit means for producing hydrocarbons from the well, said conduit means being positioned partially within the casing, and having a first end located adjacent to the first set of perforations and having a second end located at the surface of the earth;

d. a conduit means for venting the well, said conduit means positioned partially in the casing and having a first end located between the thermal packer and the first set of perforations and a second end located at the surface of the earth;

e. a steam source; and f. a conduit means for providing a flow path from the steam source to the inside of the casing.

2. An apparatus as recited in claim 1, wherein the conduit means for producing hydrocarbons comprises a first string of tubing.

3. An apparatus as recited in claim 1, wherein the conduit means for venting the well comprises a second string of tubing.

4. An apparatus as recited in claim 3, further comprising a wellhead and a production flowline connected to the wellhead, wherein the conduit means for venting the well is connected to the wellhead in flow communication with the production flowline.

5. An apparatus as recited in claim 1, wherein the first end of the means for venting the well is positioned between the first end of the means for producing hydrocarbons and the thermal packer.

6. An apparatus as recited in claim 1, wherein the conduit means for providing a flow path from the steam source to the casing set in the well comprises a pipeline in flow communication with the steam source and the casing.

7. A method for increasing hydrocarbon production from a hydrocarbon reservoir comprising:

a. setting a thermal packer in a casing within a well, said thermal packer being set between a first set of perforations and a second set of perforations which is located closer to the surface of the earth than the first set of perforations, such that said thermal packer hydraulically isolates the first set of perforations from the second set of perforations within the casing;

b. injecting steam into the second set of perforations;

c. discontinuing the injection of steam into the second set of perforations;

d. producing hydrocarbons from the first set of perforations; and e. venting an area in the well adjacent to the first set of perforations during the time that hydrocarbons are being produced.

8. A method as recited in claim 7 further comprising flowing steam through a tubular conduit to an area in the well adjacent to the second set of perforations.

9. A method as recited in claim 8 wherein the tubular conduit comprises a string of pipe at or near the surface of the earth and the casing set in the well.

10. A method as recited in claim 7, wherein the first set of perforations is produced by means of a first string of tubing having a first end located adjacent to the first of perforations and a second end connected to a wellhead on the surface of the earth, said wellhead being in flow communication with a production flowline.

11. A method as recited in claim 10, wherein the first end of the second string of tubing is located closer to the surface of the earth than the first end of the first string of tubing.

12. A method as recited in claim 7, wherein a zone adjacent to the first set of perforations is vented by means of a second string of tubing having a first end located between the thermal packer and the first set of perforations in the well, and a second end connected to a wellhead on the surface of the earth, said wellhead being in flow communication with a production flowline.

* * * * *